US009051078B2

(12) United States Patent
Martini et al.

(10) Patent No.: US 9,051,078 B2
(45) Date of Patent: Jun. 9, 2015

(54) SPOUT FOR OPENING DEVICES OF SEALED PACKAGES OF POURABLE FOOD PRODUCTS

(75) Inventors: Pietro Martini, Parma (IT); Davide Morciano, Modena (IT)

(73) Assignee: TETRA LAVAL HOLDINGS & FINANCE S.A., Pulley (CH)

( * ) Notice: Subject to any disclaimer, the term of this patent is extended or adjusted under 35 U.S.C. 154(b) by 670 days.

(21) Appl. No.: 12/159,335

(22) PCT Filed: Dec. 27, 2006

(86) PCT No.: PCT/EP2006/070229

§ 371 (c)(1),
(2), (4) Date: Jun. 26, 2008

(87) PCT Pub. No.: WO2007/074160

PCT Pub. Date: Jul. 5, 2007

(65) Prior Publication Data

US 2008/0296299 A1 Dec. 4, 2008

(30) Foreign Application Priority Data

Dec. 27, 2005 (EP) ..... 05425921

(51) Int. Cl.
*B65D 23/06* (2006.01)
*B65D 5/74* (2006.01)

(52) U.S. Cl.
CPC ..... *B65D 5/746* (2013.01)

(58) Field of Classification Search
USPC ..... 215/41, 40, 42; 220/266, 258.1, 751, 220/DIG. 5; 222/484, 547, 571
See application file for complete search history.

(56) References Cited

U.S. PATENT DOCUMENTS

| | | | | | |
|---|---|---|---|---|---|
| 185,693 | A | * | 12/1876 | Newton | 15/257.05 |
| 491,198 | A | * | 2/1893 | Straus | 215/40 |
| 763,973 | A | * | 7/1904 | Flynn | 222/572 |
| 2,035,877 | A | * | 3/1936 | Geerlings | 215/43 |
| 2,739,740 | A | * | 3/1956 | Livingstone | 222/420 |
| 3,343,698 | A | * | 9/1967 | Anderson et al. | 215/45 |
| 4,482,083 | A | * | 11/1984 | Beck | 222/500 |
| 4,850,501 | A | * | 7/1989 | Shield | 220/704 |
| 4,909,434 | A | * | 3/1990 | Jones et al. | 229/125.15 |
| 4,948,015 | A | * | 8/1990 | Kawajiri et al. | 222/107 |

(Continued)

FOREIGN PATENT DOCUMENTS

| | | |
|---|---|---|
| EP | 0 502 716 A2 | 9/1992 |
| JP | 8-104350 A | 4/1996 |

(Continued)

OTHER PUBLICATIONS

PCT/ISA/210 and PCT/ISA/237 for PCT/EP2006/070229.

(Continued)

*Primary Examiner* — Jeffrey Allen
(74) *Attorney, Agent, or Firm* — Buchanan Ingersoll & Rooney PC

(57) ABSTRACT

There is described a spout for opening devices of sealed packages of pourable food products. The spout has an annular flange fixable to a respective package, and a tubular neck portion projecting from the flange and defining, with the flange, a through opening through which to pour the food product; and the spout also has, at least at a section crosswise to the axis of the opening a constriction constricting flow of the pourable food product.

22 Claims, 2 Drawing Sheets

(56) References Cited

U.S. PATENT DOCUMENTS

| | | | | | |
|---|---|---|---|---|---|
| 5,176,300 | A * | 1/1993 | Kishikawa et al. | 222/541.5 |
| 5,472,122 | A * | 12/1995 | Appleby | 222/212 |
| 5,645,190 | A * | 7/1997 | Goldberg | 220/674 |
| 5,735,426 | A * | 4/1998 | Babcock et al. | 220/258.2 |
| 5,839,627 | A * | 11/1998 | Hicks et al. | 222/541.9 |
| 5,957,312 | A * | 9/1999 | Adams et al. | 215/45 |
| 5,964,383 | A * | 10/1999 | Cargile | 222/571 |
| 6,059,153 | A * | 5/2000 | Olson et al. | 222/465.1 |
| 6,085,949 | A * | 7/2000 | Zimny et al. | 222/572 |
| 6,129,228 | A * | 10/2000 | Adams et al. | 215/45 |
| 6,390,342 | B1 * | 5/2002 | Mabee | 222/541.9 |
| 6,454,130 | B1 * | 9/2002 | Miller et al. | 222/94 |
| 6,648,157 | B2 * | 11/2003 | Shai et al. | 215/42 |
| 6,857,542 | B1 * | 2/2005 | Mettler et al. | 222/546 |
| 7,325,687 | B2 * | 2/2008 | Bravo et al. | 206/509 |
| 7,617,950 | B2 * | 11/2009 | Norris et al. | 222/145.3 |
| 7,621,411 | B2 * | 11/2009 | Doherty et al. | 215/228 |
| 7,770,745 | B2 * | 8/2010 | Weissmann et al. | 215/42 |
| 2003/0071042 | A1 | 4/2003 | Adams | |
| 2006/0124575 | A1 * | 6/2006 | Mavin et al. | 215/252 |
| 2006/0289376 | A1 * | 12/2006 | Von Spreckelsen et al. | 215/257 |
| 2008/0296299 | A1 * | 12/2008 | Martini et al. | 220/260 |

FOREIGN PATENT DOCUMENTS

| | | | |
|---|---|---|---|
| JP | 11-91792 | A | 4/1999 |
| JP | 2001-171714 | A | 6/2001 |
| JP | 2005-41541 | A | 2/2005 |
| JP | 2005-112445 | A | 4/2005 |
| JP | 2005-212847 | A | 8/2005 |
| WO | WO 2004/041669 | A1 | 5/2004 |

OTHER PUBLICATIONS

English language translation of Japanese Office Action issued Dec. 2, 2011 by the Japanese Patent Office in corresponding Japanese Application No. 2008-547964.

* cited by examiner

SPOUT FOR OPENING DEVICES OF SEALED PACKAGES OF POURABLE FOOD PRODUCTS

TECHNICAL FIELD

The present invention relates to a spout for opening devices of sealed packages of pourable food products.

BACKGROUND ART

As is known, many pourable food products, such as fruit juice, UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- or light-barrier material, e.g. aluminium foil or ethyl vinyl alcohol (EVOH) film, which is superimposed on a layer of heat-seal plastic material, and is in turn covered with another layer of heat-seal plastic material eventually forming the inner face of the package contacting the food product.

Packages of this sort are normally produced on fully automatic packaging machines, on which a continuous tube is formed from the web-fed packaging material; the web of packaging material is sterilized on the packaging machine, e.g. by applying a chemical sterilizing agent such as a hydrogen peroxide solution, which is subsequently removed from the surfaces of the packaging material, e.g. evaporated by heating; and the web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name Tetra Rex (registered trademark).

To open packages of the type described above, various solutions have been proposed, including reclosable opening devices, which substantially comprise a spout, e.g. tubular, defining a through opening and fitted about a hole or a removable or pierceable portion of a wall of the package; and a removable, e.g. screw or hinged, cap fitted to and outwardly closing the spout.

When the opening device is fitted about a hole in the package, the opening of the spout is closed by a membrane made of plastic material, connected integrally to the spout, and detachable from the spout along a preferential, normally circular, tear line. The membrane is normally fixed to the top (i.e. outer) edge of the spout, and is fitted integrally, on the side facing the cap, with a projecting tab, which is pulled off by its free end to detach the membrane from the spout along the preferential tear line and so free the opening to pour out the product.

Though functionally valid, opening devices of the above type still leave room for further improvement, particularly as regards pour-out of the product, which is often irregular and characterized by so-called "gulping". This is caused when the package is tilted to pour out the product, and the liquid product inside, whose free surface assumes a constantly horizontal position, completely fills the spout, thus isolating the inside of the package from the outside, and so forming a vacuum inside the package which tends to slow down and even cut off outflow. As soon as any change occurs in the above condition, e.g. a change in the tilt angle of the package allowing air inside, outflow of the product is suddenly restored, thus resulting in gulping. And the greater the overall axial dimension of the spout, the greater the range of package tilt angles at which gulping occurs.

DISCLOSURE OF INVENTION

It is an object of the present invention to provide a spout for opening devices of sealed packages of pourable food products, designed to eliminate the aforementioned drawback typically associated with known spouts.

According to the present invention, there is provided a spout for opening devices of sealed packages of pourable food products, said spout comprising:

- a fastening portion by which to fasten the spout to a respective package; and
- a neck portion projecting from said fastening portion and defining, with the fastening portion, a through opening through which to pour the food product;

and being characterized by comprising, crosswise to the outflow of the food product, at least one constriction of said opening.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
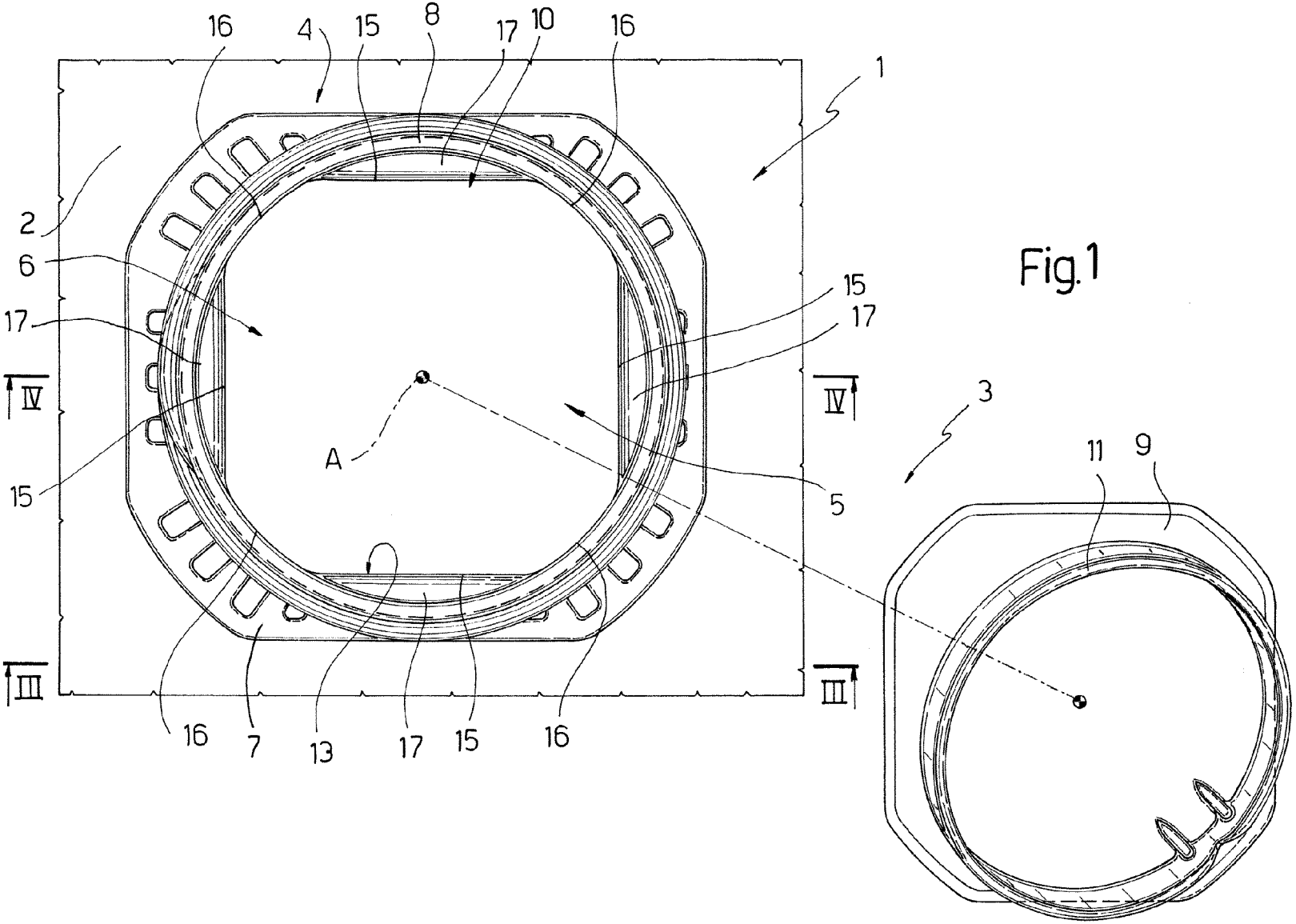
FIG. 1 shows a topside view, and in an open condition, of part of a wall of a sealed package for pourable food products fitted with a spout in accordance with the present invention.
Figure 2:
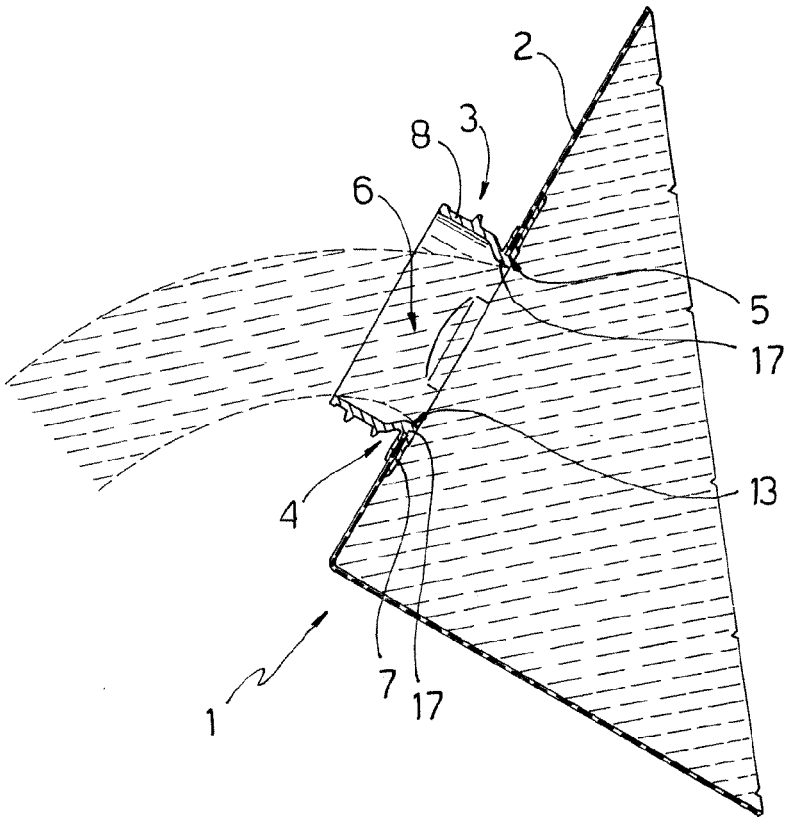
FIG. 2 shows a larger-scale section of a top portion of the FIG. 1 package when pouring the product.

Number 1 in FIGS. 1 and 2 indicates as a whole a sealed package for pourable food products, e.g. a parallelepiped-shaped package known as Tetra Brik Aseptic (registered trademark), which is made from sheet packaging material as described in detail previously, and has a reclosable opening device 3 made of plastic material on a top wall 2.

Opening device 3 substantially comprises a spout 4 formed in accordance with the teachings of the present invention and injection molded onto wall 2 of package 1; and a known removable, e.g. screw, cap (not shown) fitted to and outwardly closing spout 4.

Alternatively, spout 4 may be applied to wall 2 of package 1 by other conventional fastening systems, such as adhesives, or by means of microflame or laser sealing techniques.

The packaging material has a multilayer structure, and comprises, in wall 2 of package 1, a through hole 5, of axis A, covered externally in use by opening device 3.

The packaging material comprises a base layer for stiffness and strength, which may comprise a layer of fibrous material, e.g. paper, or mineral-filled polypropylene material. The base layer is covered on both sides with layers of heat-seal plastic material, e.g. polyethylene film; and, in the case of aseptic packages for long-storage products, such as UHT milk, the packaging material also comprises a layer of gas- or light-barrier material, e.g. aluminium foil or ethyl vinyl alcohol (EVOH) film, which is superimposed on a layer of heat-seal plastic material, and is in turn covered with another layer of heat-seal plastic material eventually forming the inner face of the package contacting the food product.

With reference to the accompanying drawings, spout 4 defines a through opening 6 coaxial with and communicating with hole 5 in wall 2 of package 1, and substantially comprises a flat annular flange 7 fixed to wall 2 of package 1, about hole 5; and a cylindrical tubular neck portion 8 projecting axially from the inner radial edge of flange 7 and defining, with flange 7, opening 6 through which to pour out the food product. In the embodiment shown in the accompanying drawings, neck portion 8 is threaded externally to engage a respective screw cap.

Spout 4 is produced initially in a closed configuration, i.e. in which it comprises a membrane 9, which is made of plastic material, seals opening 6 outwardly, is connected integrally to spout 4, and is detachable from spout 4 along a preferential tear line 10 (FIG. 1).

On the side facing the cap in use, membrane 9 is fitted integrally with a projecting annular pull-off tab 11 by which to detach membrane 9 from spout 4 along preferential tear line 10 and so free opening 6 to pour out the product.

Advantageously, membrane 9 is substantially on a level with flange 7, and is joined to the inner radial edge of flange 7 by preferential tear line 10.

In this way, the area in which gas and light might penetrate opening device 3 is minimized. If membrane 9, in fact, were located an axial distance D from flange 7, the potential gas and light entry area would be defined not only by the section corresponding to opening 6, but also by the lateral surface of neck portion 8 corresponding to axial distance D.

Spout 4 advantageously comprises, at least at a section crosswise to axis A or to the outflow of the food product, a constriction 13 of opening 6.

Constriction 13 is substantially formed on a level with flange 7 and is preferably polygonal—in the example shown, octagonal with straight sides 15 alternating with curved sides 16 (FIG. 1).

Figure 3:
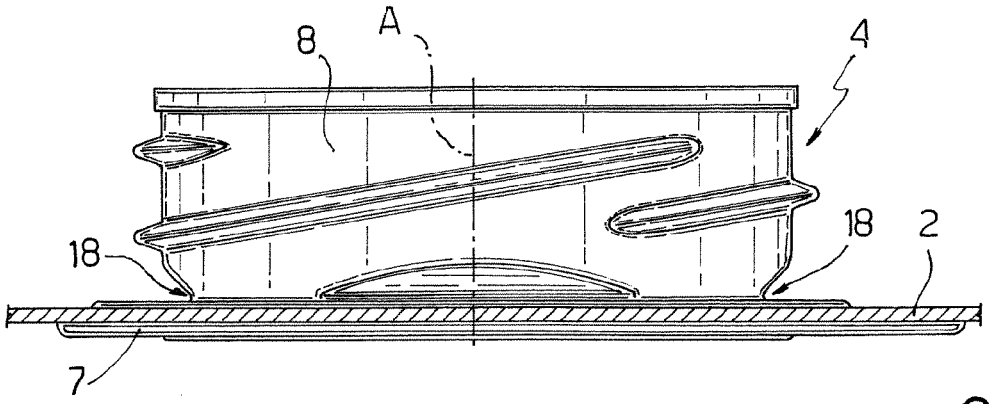
FIG. 3 shows a section along line III-III in FIG. 1.
Figure 4:
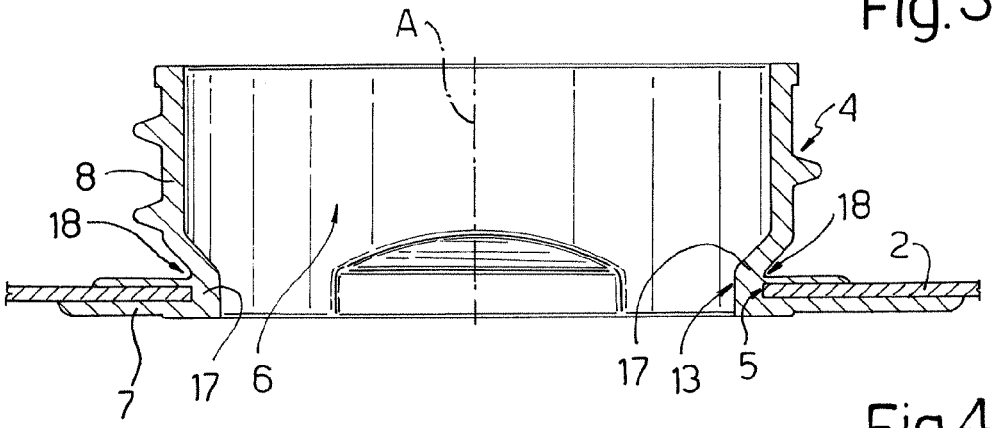
FIG. 4 shows a section along line IV-IV in FIG. 1.

More specifically, each straight side 15 is defined by a projection 17 projecting inwards of opening 6 and hollow on the opposite side, i.e. outwards of spout 4, so as to define a sort of recess 18 on spout 4 (FIGS. 3 and 4).

Straight sides 15 are arranged in twos parallel to each other and on diametrically opposite sides of axis A of opening 6.

Curved sides 16, on the other hand, are defined by the circular contour of neck portion 8.

The advantages of spout 4 according to the present invention will be clear from the foregoing description.

In particular, as shown in FIG. 1, when pouring out the food product, constriction 13 partly detaches flow from the inner surface of neck portion 8 in a direction substantially perpendicular to the flow direction, thus allowing air into package 1 to maintain a balance between the pressure inside and outside package 1, so that the food product is poured out smoothly with no gulping.

Moreover, by virtue of constriction 13 being formed by projections 17 outwardly defining respective recesses 18 on spout 4, the final food product outflow section and, hence, the diameter of neck portion 8 are maximized with respect to the area available on package 1, i.e. with respect to the area of hole 5 in the packaging material.

Finally, as stated, membrane 9 being directly on a level with flange 7 and, therefore, with wall 2 of package 1 minimizes the potential gas and light entry area, and at the same time facilitates removal of the sterilizing agent from opening device 3 by evaporation following the known sterilization process. That is, any corner area, where sterilizing agent may accumulate, is eliminated.

Clearly, changes may be made to spout 4 as described and illustrated herein without, however, departing from the protective scope as defined in the accompanying Claims.

In particular, neck portion 8 of spout 4 may be other than cylindrical, e.g. shaped to define an oval pour opening 6.

The invention claimed is:

1. A spout to be mounted on packaging material constructed to form a sealed package of pourable food product and permit the pourable food product in the sealed package to be dispensed from the sealed package, said spout comprising:

a fastening portion by which to fasten the spout to the packaging material, the fastening portion possessing an axial end-most end surface which will face toward the pourable food product;

a neck portion projecting from said fastening portion and defining, with the fastening portion, a through opening through which to pour the food product, the neck portion having an end surface facing away from the fastening portion, and the through opening extending from one remote end which intersects the end surface of the fastening portion to an opposite remote end which intersects the end surface of the neck portion;

crosswise to the outflow of the food product, at least one constriction of said opening;

the constriction comprising a plurality of interiorly located and circumferentially spaced apart projections projecting inwardly toward the opening relative to portions immediately adjoining the projections, each of the projections extending from the one remote end which intersects the axial end most surface of the fastening portion toward the opposite remote end, and terminating at an end spaced from the opposite remote end so that the end of each projection is positioned between the one remote end and the opposite remote end, each of the projections being hollow on an outer side facing away from the opening to define a corresponding recess on an outer surface of the spout that is circumferentially and vertically aligned with the projection;

the through opening including a part extending axially from the ends of the projections to the opposite remote end, the entirety of said part of the through opening extending from the ends of the projections to the opposite remote end possessing an inner diameter greater than an inner dimension of the through opening at the projections;

the part of the through opening extending axially from the ends of the projections to the opposite remote end possessing a cylindrical shape; and the plurality of interiorly located and circumferentially spaced apart projections including a total of four projections, a first pair of the projections being positioned in opposing relation to each other and a second pair of the projections being positioned in opposing relation to each other, the four projections being spaced apart from one another in a circumferential direction with a single curved surface located between circumferentially adjacent projections, each of the curved surfaces being a continuation of the cylindrical shape.

2. A spout as claimed in claim 1, wherein said constriction has a polygonal contour.

3. A spout as claimed in claim 2, wherein said constriction has an octagonal contour with straight sides alternating with curved sides.

4. A spout as claimed in claim 3, wherein said straight sides are arranged in twos parallel to each other.

5. A spout as claimed in claim 3 wherein each said straight side is defined by one of the projections.

6. A spout as claimed in claim 5, wherein each said projection defines a respective recess outwards of the spout.

7. A spout as claimed in claim 1, wherein, adjacent to said constriction, said opening has a circular contour.

8. A spout as claimed in claim 1, wherein said opening is covered with a membrane made of plastic material, connected integrally to the spout and detachable from the spout along a tear line.

9. A spout molded on a packaging material configured to form a sealed package of pourable food product, said spout comprising:

an annular flange fixed to a surface of the packaging material by virtue of the spout being molded onto the packaging material such that a portion of the spout is positioned in a through hole in the packaging material, the annular flange having an axial end-most end surface which will face toward the pourable food product in the sealed package;

a cylindrically shaped neck portion projecting axially from the annular flange, the neck portion having an end surface facing away from the flange;

an axially extending through opening passing through both the neck portion and the annular flange, the through opening forming a pour opening through which to pour the food product when the packaging material to which the spout is molded is formed into the sealed package of pourable food product, the through opening extending from one remote end which intersects the end surface of the annular flange to an opposite remote end which intersects the end surface of the neck portion, the through opening possessing an axis;

at least one constriction in the through opening so that a cross-sectional area of the through opening at the constriction is less than the cross-sectional area of the through opening at places other than the constriction;

the constriction comprising a plurality of interiorly located and circumferentially spaced apart projections projecting inwardly toward the opening relative to portions immediately adjoining the projections, each of the projections extending from the one remote end which intersects the axial end-most end surface of the annular flange toward the opposite remote end, and terminating at an end spaced from the opposite remote end so that the end of each projection is positioned between the one remote end and the opposite remote end, the plurality of projections including two diametrically opposed projections spaced apart by a distance;

the through opening including an axially extending portion which extends from the ends of the projections to the opposite remote end, the entirety of said axially extending portion of the through opening which extends from the ends of the projections to the opposite remote end possessing an inner diameter greater than the distance between the two diametrically opposed projections the axially extending portion of the through opening which extends from the ends of the projections to the opposite remote end possessing a cylindrical shape; and the plurality of interiorly located and circumferentially spaced apart projections including a total of four projections, the four projections being spaced apart from one another in a circumferential direction, with a single curved surface positioned between circumferentially adjacent projections so that the cross-sectional shape of the through opening at the constriction is an octagonal cross-section defined by four curved sides each constituted by one of the curved surfaces and four straight sides each constituted by one of the projections, each of the curved surfaces being a continuation of the cylindrical shape.

10. A spout as claimed in claim 9, wherein the constriction has a polygonal contour.

11. A spout as claimed in claim 9, wherein the constriction has an octagonal contour with straight sides alternating with curved sides.

12. A spout as claimed in claim 11, wherein the straight sides are arranged in twos parallel to each other.

13. A spout as claimed in claim 11, wherein each of the straight sides is defined by one of the projections projecting inwards of the opening.

14. A spout as claimed in claim 13, wherein each of the projections defines a respective recess outwards of the spout.

15. A spout as claimed in claim 9, wherein the opening has a circular contour adjacent to the constriction.

16. A spout as claimed in claim 9, wherein the opening is covered with a membrane made of plastic material, connected integrally to the spout and detachable from the spout along a tear line.

17. A spout as claimed in claim 9, wherein the four projections include the two diametrically opposed projections being a first pair of the projections, and a second pair of diametrically opposed projections.

18. A spout mounted on a sealed package containing pourable food product to permit the pourable food product in the sealed package to be dispensed from the sealed package, the sealed package possessing a wall having a through hole, the spout being molded on the wall and comprising:

an annular flange;

a neck portion projecting from the flange;

the neck portion defining with the flange an axially extending through opening through which to pour the food product, the through hole possessing a central axis;

the flange being sealed to the wall of the sealed package so that the opening is coaxial with the through hole in the sealed package;

the flange possessing an axial end-most end surface which faces towards the pourable food product in the sealed package, the neck portion having an end surface facing away from the flange;

the through opening extending from one remote end which intersects the end surface of the flange to an opposite remote end which intersects the end surface of the neck portion;

the through opening including at least one constriction crosswise to outflow of the food product from the sealed package;

the neck portion and the flange possessing an inner peripheral surface, the at least one constriction comprising a plurality of interiorly located and circumferentially spaced apart projections each possessing an inwardly facing straight side, and a curved portion of the inner peripheral surface being positioned between each circumferentially adjacent pair of projections;

each of the projections extending from the one remote end which intersects the end surface of the flange toward the opposite remote end, and terminating at an end spaced from the opposite remote end so that the end of each projection is positioned between the one remote end and the opposite remote end;

two of the projections being positioned in diametrically opposing relation to one another and being spaced apart by a distance;

an axially extending part of the through opening in the neck portion extending from the ends of the projections to the opposite remote end of the through opening, the entirety of said axially extending part of the through opening in the neck portion possessing an inner dimension greater than the distance between the two projections;

the through hole in the wall possessing an inner diameter less than an outermost outer diameter of the axially extending part of the through opening in the neck portion the through opening including an axially extending portion which extends from the ends of the projections to the opposite remote end, the axially extending portion of the through opening which extends from the ends of the projections to the opposite remote end possessing a cylindrical shape; and the plurality of interiorly located and circumferentially spaced apart projections consisting of four projections, the four projections being spaced apart from one another in a circumferential direction, with a single curved surface positioned between circumferentially adjacent projections so that the cross-sectional shape of the through opening at the constriction is an octagonal cross-section defined by four curved sides alternating with four straight sides, each curved side being constituted by one of the curved surfaces and each of the straight sides being constituted by one of the projections, each of the curved surfaces being a continuation of the cylindrical shape of the axially extending portion of the through opening which extends from the ends of the projections to the opposite remote end.

19. A spout as claimed in claim 18, wherein the axial end-most end surface of the flange is located inside the sealed packaging container.

20. A spout as claimed in claim 18, wherein the through opening is covered with a membrane made of plastic material, connected integrally to the spout and detachable from the spout along a tear line.

21. A spout to be mounted on packaging material constructed to form a sealed package of pourable food product and permit the pourable food product in the sealed package to be dispensed from the sealed package, said spout comprising:

a fastening portion by which to fasten the spout to the packaging material, the fastening portion possessing an axial end-most end surface which will face toward the pourable food product;

a neck portion projecting from the fastening portion and defining, with the fastening portion, a through opening through which to pour the food product, the neck portion having an end surface facing away from the fastening portion, and the through opening extending from one remote end which intersects the end surface of the fastening portion to an opposite remote end which intersects the end surface of the neck portion;

four circumferentially spaced apart and inwardly projecting projections located inside the neck portion crosswise to the outflow of the food product to constrict the opening, each of the four projections possessing an inwardly facing straight side;

two of the projections forming a first pair of the projections positioned in opposing facing relation to each other and spaced apart from each other by a first distance, the other two of the projections forming a second pair of the projections positioned in opposing facing relation to each other and spaced apart from each other by a second distance;

each of the four projections extending from the one remote end which intersects the axial end most surface of the fastening portion toward the opposite remote end, and terminating at an end spaced from the opposite remote end so that the end of each projection is positioned between the one remote end and the opposite remote end;

the through opening possessing an octagonal cross-section from the one remote end which intersects the end surface of the fastening portion to the ends of the projections, the octagonal cross-section being defined by the straight sides of the four projections and four curved sides each positioned between pairs of circumferentially adjacent straight sides;

the through opening possessing a circular cross-section from the ends of the projections to the opposite remote end;

the circular cross-section which extends from the ends of the projections to the opposite remote end possessing an area greater than the area of the octagonal cross-section which extends from the one remote end to the ends of the projections; and each of the projections being hollow on an outer side to define an inwardly directed recess on an outer surface of the neck portion.

22. The spout according to claim 21, wherein the cross-section of the outer surface of the neck portion between the one remote end which intersects the end surface of the fastening portion and the ends of the projections includes four straight sides each corresponding to one of the recesses, and wherein the cross-section of the outer surface of the neck portion from the ends of the projections to the opposite remote end is circular.

* * * * *